US005831578A

United States Patent [19]

Lefevre

[11] Patent Number: 5,831,578

[45] Date of Patent: Nov. 3, 1998

[54] MICROWAVE ANTENNA ELEMENT

[75] Inventor: Jean-Patrick Lefevre, Palaiseau, France

[73] Assignee: Compagnie Generale D'Automatisme CGA-HBS, Sur Orge, France

[21] Appl. No.: 721,206

[22] Filed: Sep. 26, 1996

[30] Foreign Application Priority Data

Sep. 27, 1995 [FR] France ..... 95 11316

[51] Int. Cl.[6] ..... H01Q 1/26

[52] U.S. Cl. ..... 343/700 MS; 343/702; 343/846

[58] Field of Search ..... 343/700 MS, 702, 343/829, 830, 846; H01Q 1/28, 1/38, 13/10

[56] References Cited

U.S. PATENT DOCUMENTS

| | | | |
|---|---|---|---|
| 4,633,262 | 12/1986 | Traut | 343/700 |
| 4,827,271 | 5/1989 | Berneking et al. | 343/700 MS |
| 4,849,765 | 7/1989 | Marko | 343/700 |
| 4,907,006 | 3/1990 | Nishikawa et al. | 343/700 |
| 4,994,820 | 2/1991 | Suzuki et al. | 343/700 |
| 5,537,123 | 7/1996 | Mandai et al. | 343/700 |

FOREIGN PATENT DOCUMENTS

| | | |
|---|---|---|
| 0117017A1 | 8/1984 | European Pat. Off. . |
| 4130493A1 | 3/1993 | Germany . |

OTHER PUBLICATIONS

Gorobets et al, "An Experimental Investigation of a Low–Profile Antenna with Circular Polarization", *Telecommunications and Radio Engineering,* vol. 43, No. 4, Apr. 1988, pp. 109–111.

H. An et al, "Broadband Circulary Polarised Microstrip Antenna in Two–Sided Structure with Coaxial Probe Coupling", *Electronics Letters,* vol. 29, No. 3, Feb. 4, 1993, pp. 310–312.

*Primary Examiner*—Hoanganh T. Le
*Assistant Examiner*—Tho Phan
*Attorney, Agent, or Firm*—Sughrue, Mion, Zinn, Macpeak & Seas, PLLC

[57] ABSTRACT

A microwave antenna element comprising a ground plane printed on an insulating substrate and an antenna plate having at least one antenna outlet. The ground plane and the antenna plate are separated by a dielectric, wherein the dielectric separating the plate from the ground plane is air. The antenna plate is constituted by a conductive plate of a shape adapted to the polarization of the transmission microwave vector. The antenna plate has at least two legs formed by stamping and folding which serve to support the plate on the substrate. Each leg passes through a respective orifice in the substrate, at least one of the legs serves not only for support purposes, but also constitutes an antenna outlet. There is a gap in the ground plane surrounding the orifice via which each leg of the antenna outlet passes through the substrate.

11 Claims, 1 Drawing Sheet

MICROWAVE ANTENNA ELEMENT

The present invention relates to a microwave antenna element. An intended application is remote payment.

More particularly, the invention relates to antennas of the type comprising a dielectric substrate having one of its surfaces carrying a printed ground plane and having its other surface carrying a printed plate of a shape adapted to the polarization of the transmission microwave vector, said plate having one or more antenna outlets. Such a plate is generally called a "patch".

BACKGROUND OF THE INVENTION

Microwave antennas of this type are printed to class 5 accuracy on a substrate of low dielectric constant specially dedicated to microwaves, e.g. a cyanate-ester substrate or a glass-Teflon substrate known under the name "Duroïde". Such substrates are expensive, three or four times the price of standard substrates for printed circuits made of "FR4" or of glass epoxy, and in addition they do not have the same mechanical qualities.

In addition, the circuitry is required to be printed with class 5 accuracy or better, whereas conventional printed circuits require only class 3 or 4. Finally, mass production requires continuous quality control of each batch of substrate, since there is no guarantee that the value of its dielectric constant $\epsilon_r$ is the same from one batch to another.

OBJECTS AND SUMMARY OF THE INVENTION

Thus, an object of the invention is to propose a high performance microwave antenna element of considerably lower cost, being about one-fourth or one-fifth the cost of present microwave antennas.

The invention thus provides a microwave antenna element comprising a ground plane printed on an insulating substrate and an antenna plate having at least one antenna outlet, the ground plane and the plate being separated by a dielectric, wherein said dielectric separating the plate from the ground plane is air, wherein said plate is constituted by a conductive plate of a shape adapted to the polarization of the transmission microwave vector, said antenna plate having at least two legs formed by stamping and folding and serving to support the plate on the substrate, each leg passing through a respective orifice in the substrate, at least one of the legs serving not only for support purposes, but also constituting an antenna outlet, there being a gap in the ground plane surrounding each orifice via which a respective antenna outlet leg passes through the substrate.

According to another characteristic, the through orifice for each leg is metal-plated, the metal plating extending to cover the edges of the orifice on the face of the substrate opposite from its face carrying the ground plane to enable the legs to be fixed to the substrate by soldering.

In a particular embodiment for a circularly polarized microwave antenna, the antenna plate is square in shape and has three legs, one of which is situated in the center of the plate and forms a short circuit between the antenna plate and the ground plane, while the other two legs constitute two antenna outlets situated on respective median lines of the antenna plate and respectively constituting an in-phase link and a quadrature link.

Advantageously, each of said two antenna outlets is connected to a respective outlet terminal fixed on an edge of said insulating substrate via a rectilinear connection of circuit printed on the surface of the substrate opposite from the ground plane, the two connections being mutually perpendicular.

BRIEF DESCRIPTION OF THE DRAWING

An embodiment of the invention is described below with reference to the accompanying drawing, in which.

MORE DETAILED DESCRIPTION

Figure 1:
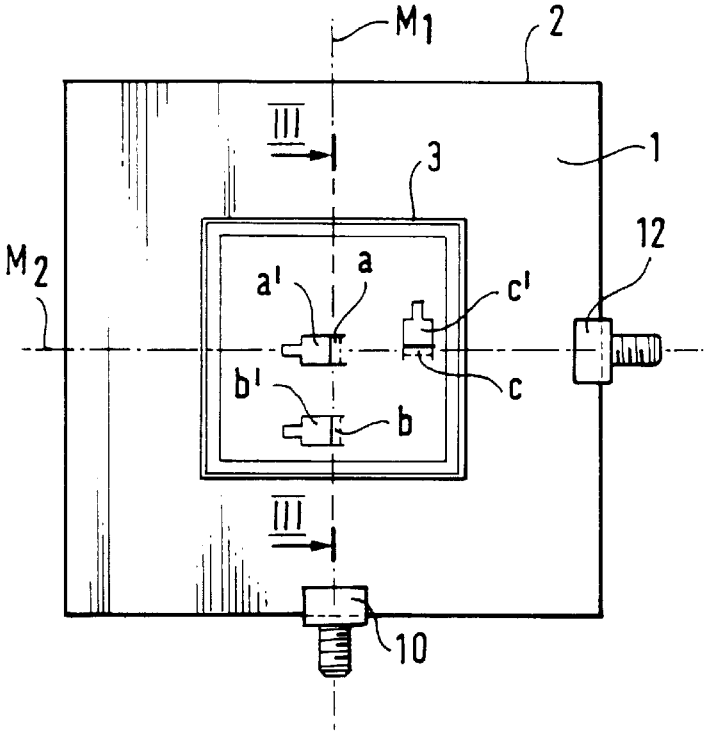
FIG. 1 shows a microwave antenna element of the invention in plan view from above.

The example described is a C-band (5.8 GHz) microwave antenna having a gain of 9 dB, with divergence angles of 60° at −3 dB, a passband >200 MHz, with lefthand circular polarization and cross-polarization <15 dB on the axis and <10 dB at −3 dB.

With reference to the figures, the antenna element comprises a ground plane 1 printed on the entire surface of an insulating substrate 2 (of standard type as used in printed circuits, such as FR4 or glass epoxy), and an antenna plate 3. It is constituted by a dish-shaped square plate of copper. The dielectric 4 between the ground plane 1 and the antenna plate 3 is air. Thus, $\epsilon_r=1$.

The antenna plate 3 has three legs a, b, and c serving to support it in stable manner on the substrate 2 and to maintain the thickness e of the dielectric 4 between the ground plane 1 and the antenna plate 3.

The legs a, b, and c are made by stamping and folding, and they therefore leave respective holes a', b', and c' in the plate 3.

Each leg has a peg 5 that passes through the substrate 2 and that projects a little from the other side for soldering 6. To this end, the orifices which receive the pegs 5 of the legs a, b, and c include metal plating 7 (obtained by printed circuit techniques), with the metal plating 7 extending to cover the edges of the orifices on the face of the substrate 2 opposite from its face carrying the ground plane 1. In addition to its peg 5, each leg has a wider portion 8 of length that determines the thickness e.

Figure 2:
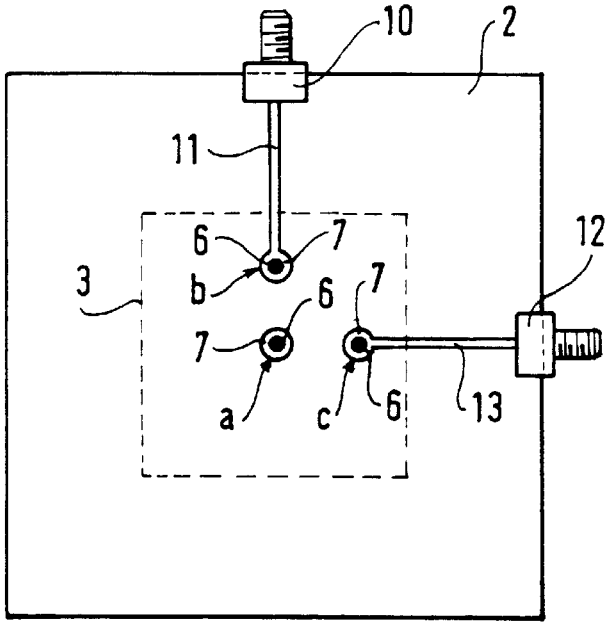
FIG. 2 shows the same antenna element seen from below.

In addition to performing a support function, the legs b and c provide the outlet of the antenna. In the example described, the leg b provides the in-phase link and the leg c provides the quadrature link. As can be seen in FIGS. 1 and 2, these legs are situated respectively on median line $M_1$ and on median line $M_2$ of the square geometrical figure constituted by the antenna plate 3.

To avoid a short circuit between the antenna plate 3 and the ground plane 1, a gap 9 constituted by an absence of ground plane is provided on the substrate 2 around the legs b and c. In contrast, the central leg 1 constitutes a short circuit between the antenna plate 3 and the ground plane 1.

On the other face of the substrate 2, as shown in FIG. 2, the leg b-is connected to a first output terminal 10 by a rectilinear printed circuit connection 11, and similarly the leg c is connected to a second output terminal 12 by a rectilinear printed circuit connection 13. The two connections 11 and 13 are mutually perpendicular. The output terminals 10 and 12 are fixed on two consecutive sides of the square of the substrate 2.

Figure 3:
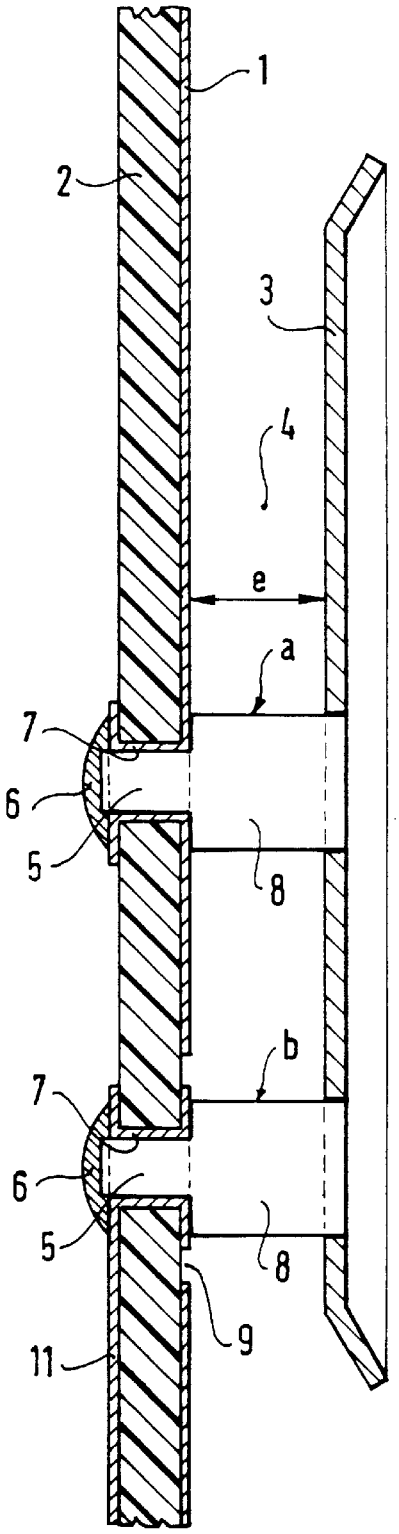
FIG. 3 shows the antenna element in section on III—III of FIG. 1.

The antenna plate 3 is stamped in a sheet of copper but because of the thinness thereof, its edges are raised, as can be seen in FIG. 3, so as to ensure overall stiffness.

It will be observed that this raising of the edges and the making of the holes a', b', and c' does not interfere with the performance of the antenna, and indeed its characteristics are better than those of an equivalent conventional antenna printed on a dielectric that is specially dedicated to microwave antennas, of the kind described in the introduction.

Thus, the invention uses a stamped sheet of copper as its radiating element without requiring additional parts for mounting it on the substrate 2. The substrate is a conventional printed circuit substrate made of FR4 or of glass epoxy. The component as a whole is compatible with automatic positioning machines used in mass production.

The invention can be applied to a wide variety of configurations, in particular for frequencies that are very different and with multiple basic elements in association (antennas made up of a plurality of individual antenna plates of shapes adapted to the polarization of the transmission microwave vector).

By way of example, in the embodiment described, the antenna plate 3 is a square of side 21.2 mm, the substrate 2 with the ground plane 1 has a thickness of 0.8 mm, the distance e is 1.8 mm, and the length of the pegs 5 is 1 mm.

I claim:

1. A microwave antenna element comprising a ground plane printed on an insulating substrate and an antenna plate having at least two antenna outlets, the ground plane and the antenna plate being separated by a dielectric, wherein said dielectric separating the plate from the ground plane is air, wherein said plate is constituted by a conductive plate of a shape adapted to the polarization of the transmission microwave vector, said antenna plate having at least two legs formed by stamping and folding and serving to support the plate on the substrate, each leg passing through a respective orifice in the substrate, at least two of the legs serving not only for support purposes, but also constituting antenna outlets, there being a gap in the ground plane surrounding each orifice via which a respective antenna outlet leg passes through the substrate.

2. A microwave antenna element according to claim 1, further comprising at least two holes in said antenna plate, each hole corresponding to one leg.

3. A microwave antenna element according to claim 1, wherein one of said antenna outlets is an in-phase link.

4. A microwave antenna element according to claim 3, wherein one of said antenna outlets is a quadrature link.

5. A microwave antenna element according to claim 4, wherein said in-phase link and said quadrature link are each situated on respective median lines of the antenna plate.

6. A microwave antenna element according to claim 1, wherein one of said antenna outlets is a quadrature link.

7. A microwave antenna element according to claim 6, wherein one of said antenna outlets is an in-phase link.

8. A microwave antenna element according to claim 7, wherein said in-phase link and said quadrature link are each situated on respective median lines of the antenna plate.

9. A microwave antenna element comprising a ground plane printed on an insulating substrate and an antenna plate having at least one antenna outlet, the ground plane and the antenna plate being separated by a dielectric, wherein said dielectric separating the plate from the ground plane is air, wherein said plate is constituted by a conductive plate of a shape adapted to the polarization of the transmission microwave vector, said antenna plate having at least two legs formed by stamping and folding and serving to support the plate on the substrate, each leg passing through a respective orifice in the substrate, at least one of the legs serving not only for support purposes, but also constituting an antenna outlet, there being a gap in the ground plane surrounding each orifice via which a respective antenna outlet leg passes through the substrate, wherein the through orifice for each leg is metal-plated, the metal plating extending to cover the edges of the orifice on the face of the substrate opposite from its face carrying the ground plane to enable the legs to be fixed to the substrate by soldering.

10. A microwave antenna element according to claim 9, wherein the antenna plate is square in shape and has three legs, one of which is situated in the center of the plate and forms a short circuit between the antenna plate and the ground plane, while the other two legs constitute two antenna outlets situated on respective median lines and of the antenna plate and respectively constituting an in-phase link and a quadrature link.

11. A microwave antenna element according to claim 10, wherein each of said two antenna outlets is connected to a respective outlet terminal fixed on an edge of said insulating substrate via a rectilinear connection of circuit printed on the surface of the substrate opposite from the ground plane, the two connections being mutually perpendicular.

* * * * *